US011725260B1

(12) United States Patent
Cui et al.

(10) Patent No.: US 11,725,260 B1
(45) Date of Patent: Aug. 15, 2023

(54) COMPOSITIONS, ARTICLES AND METHODS FOR FORMING THE SAME

(71) Applicant: General Electric Company, Schenectady, NY (US)

(72) Inventors: Yan Cui, Greer, SC (US); Jon Conrad Schaeffer, Greenville, SC (US); Michael Douglas Arnett, Simpsonville, SC (US); Matthew Joseph Laylock, Easley, SC (US); Brian Lee Tollison, Honea Path, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/716,405

(22) Filed: Apr. 8, 2022

(51) Int. Cl.
*C22C 19/05* (2006.01)
*C22F 1/10* (2006.01)

(52) U.S. Cl.
CPC ..... *C22C 19/056* (2013.01); *C22F 1/10* (2013.01)

(58) Field of Classification Search
CPC ..... C22C 19/056; C22F 1/10
See application file for complete search history.

(56) References Cited

U.S. PATENT DOCUMENTS 9,404,388 B2 8/2016 Feng et al.
2015/0247422 A1 1/2015 Yang et al.

FOREIGN PATENT DOCUMENTS

EP 1433865 A1 * 6/2004 ..... C22C 19/056

* cited by examiner

*Primary Examiner* — Jessee R Roe
(74) *Attorney, Agent, or Firm* — Dority & Manning, P.A.

(57) ABSTRACT

Compositions, and articles and methods for forming articles which include said compositions, are disclosed. The compositions include, by weight percent, about 13.7% to about 14.3% chromium (Cr), about 9.0% to about 9.9% cobalt (Co), about 4.0% to about 5.25% aluminum (Al), about 0.5% to about 3.0% titanium (Ti), about 4.5% to about 5.0% tungsten (W), about 1.4% to about 1.7% molybdenum (Mo), about 3.25% to about 3.75% niobium (Nb), about 0.08% to about 0.12% carbon (C), about 0.005% to about 0.04% zirconium (Zr), about 0.010% to about 0.014% boron (B), and balance nickel (Ni) and incidental impurities.

20 Claims, 3 Drawing Sheets

COMPOSITIONS, ARTICLES AND METHODS FOR FORMING THE SAME

FIELD

The present disclosure relates to nickel-based super alloy compositions, articles, and methods for making the same.

BACKGROUND

Turbomachines such as gas turbines can be utilized in fields such as power generation and aircraft engines. A gas turbine system itself may include a compressor section, a combustor section, and at least one turbine section.

The turbine section is located downstream of a combustor section and contains a rotor shaft and one or more turbine stages, each having a turbine disk (rotor) mounted or otherwise carried by the shaft and turbine blades mounted to and radially extending from the periphery of the disk. Components within the combustor and turbine sections may be formed of superalloy materials in order to achieve acceptable mechanical properties while at elevated temperatures resulting from the hot combustion gases. Suitable alloy compositions and microstructures for a given component may depend on the particular temperatures, stresses, and other conditions to which the component is subjected during operation of the gas turbine.

Nickel-based super alloys are used in gas turbine applications, in addition to other high temperature applications, due to their ability to withstand elevated operating temperatures. However, depending in part on specific compositions, nickel-based super alloys may nonetheless have limitations with respect to castability, oxidization resistance, strength, strain, and or weldability. Accordingly, alternative nickel-based super alloys would be welcomed in the art.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
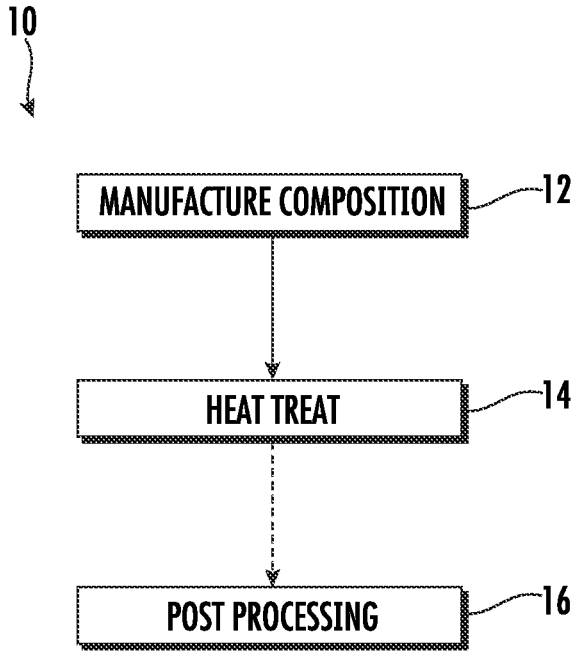
FIG. 1 is an exemplary method in accordance with one or more embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The term "at least one of" in the context of, e.g., "at least one of A, B, and C" refers to only A, only B, only C, or any combination of A, B, and C.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin. These approximating margins may apply to a single value, either or both endpoints defining numerical ranges, and/or the margin for ranges between endpoints.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

As used herein, the term "substantially devoid" is understood to mean completely free of said constituent, or inclusive of trace amounts of same. "Trace amounts" are those quantitative levels of chemical constituent that are barely detectable and provide no benefit to the functional or aesthetic properties of the subject composition. The term "substantially devoid" also encompasses completely devoid.

As used herein, the term "substantially equal" is understood to be inclusive of a minor trace variation of a quantitative level that is barely detectable and provides no benefit to the functional or aesthetic properties of the subject composition. The term "substantially equal" also encompasses completely equal.

As used herein, "substantially" refers to at least about 99% or more of the described group. For instance, as used herein, "substantially all" indicates that at least about 99% or more of the respective group have the applicable trait and "substantially no" or "substantially none" indicates that at least about 99% or more of the respective group do not have the applicable trait.

The term "turbomachine" or "turbomachinery" refers to a machine including one or more compressors, a heat generating section (e.g., a combustion section), and one or more turbines that together generate a torque output.

The term "gas turbine engine" refers to an engine having a turbomachine as all or a portion of its power source. Example gas turbine engines include turbofan engines, turboprop engines, turbojet engines, turboshaft engines, etc., as well as hybrid-electric versions of one or more of these engines.

The term "combustion section" refers to any heat addition system for a turbomachine. For example, the term combustion section may refer to a section including one or more of a deflagrative combustion assembly, a rotating detonation combustion assembly, a pulse detonation combustion assembly, or other appropriate heat addition assembly. In certain example embodiments, the combustion section may include an annular combustor, a can combustor, a cannular combustor, a trapped vortex combustor (TVC), or other appropriate combustion system, or combinations thereof.

The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, the terms "axial" and "axially" refer to directions and orientations that extend substantially parallel to a centerline of the gas turbine engine. Moreover, the terms "radial" and "radially" refer to directions and orientations that extend substantially perpendicular to the centerline of the gas turbine engine. In addition, as used herein, the terms "circumferential" and "circumferentially" refer to directions and orientations that extend arcuately about the centerline of the gas turbine engine.

The present disclosure is generally related to nickel-based super alloys, including articles comprising nickel-based super alloys and methods for manufacturing nickel-based super alloys. Some nickel-based super alloys, such as GTD-111, GTD-141, and GTD-141+, comprise alloys that are capable of enduring elevated temperatures like those present in operating gas turbines. However, depending in part on specific compositions, nickel-based super alloys may nonetheless have limitations with respect to castability, oxidization resistance, strength, strain, and or weldability.

As disclosed herein, a composition, such as for an article, can comprise by weight percent about 13.7% to about 14.3% chromium (Cr), about 9.0% to about 9.9% cobalt (Co), about 4.0% to about 5.25% aluminum (Al), about 0.5% to about 3.0% titanium (Ti), about 4.5% to about 5.0% tungsten (W), about 1.4% to about 1.7% molybdenum (Mo), about 3.25% to about 3.75% niobium (Nb), about 0.08% to about 0.12% carbon (C), about 0.005% to about 0.04% zirconium (Zr), about 0.010% to about 0.014% boron (B), and the balance comprising nickel (Ni) and incidental impurities.

While ranges are disclosed herein, it should be appreciated that the weight percent of one or more constituents may be further tailored into different ranges to achieve tailored mechanical properties of the resulting material, including those constituents having ranges distinct from previous nickel-based super alloys (e.g., aluminum (Al), titanium (Ti), tungsten (W), and Niobium (Nb)).

For example, in some embodiments, the composition may comprise, by weight percent, about 4.25% to about 5.20% aluminum (Al), about 4.4% to about 5% aluminum (Al), or from about 4.6% to about 4.8% aluminum (Al). In some embodiments, the composition may comprise, by weight percent, about 1.0% to about 2.0% titanium (Ti), or about 1.2% to about 1.8% titanium (Ti), or about 1.4% to about 2.6% titanium (Ti).

In some embodiments, the weight percent of aluminum (Al) and the weight percent of titanium (Ti) may be constrained by the amount of the other respective component. For example, the weight percent of aluminum (Al) with respect to the weight percent of titanium (Ti) may be defined by the following formula:

$$Al=-0.5*Ti+5.5\pm0.05$$

It should be appreciated that the even within the scope of the above formula, aluminum (Al) would still be held within the range of about 4.0% to about 5.25% weight percent, and titanium would still be held within the range of about 0.5% to about 3.0%.

Moreover, in some embodiments, the composition may comprise, by weight percent, about 4.6% to about 4.9% tungsten (W), about 4.7% to about 4.8% tungsten (W), or about 4.72% to about 4.78% tungsten (W). In some embodiments, the composition may comprise, by weight percent, by weight percent about 3.35% to about 3.65% niobium (Nb), by weight percent about 3.4% to about 3.6% niobium (Nb), or by weight percent about 3.45% to about 3.55% niobium (Nb).

Further constituents in the composition may also vary within one or more smaller rangers. For example, in some embodiments, the composition may comprise, by weight percent, about 13.9% to about 14.1% chromium (Cr) or about 13.95% to about 14.05% chromium (Cr). In some embodiments, the composition may comprise, by weight percent, about 9.25% to about 9.75% chromium (Co), or about 9.4% to about 9.6% chromium (Co). In some embodiments, the composition may comprise, by weight percent, about 1.5% to about 1.6% molybdenum (Mo) or about 1.52% to about 1.58% molybdenum (Mo). In some embodiments, the composition may comprise, by weight percent, about 0.09% to about 0.11% carbon (C) or about 0.095% to about 0.10% carbon (C). In some embodiments, the composition may comprise, by weight percent, about 0.001% to about 0.03% zirconium (Zr) or about 0.005% to about 0.020% zirconium (Zr). In some embodiments, the composition may comprise, by weight percent, about 0.011% to about 0.013% boron (B) or about 0.0115% to about 0.0125% boron (B). Additionally, the overall composition may be free of other constituents such as tantalum (Ta).

Thus, in total, the overall composition may vary within one or more narrower ranges for the various elemental constituents. For example, in some embodiments, the overall composition may comprise, by weight percent, about 13.7% to about 14.3% chromium (Cr), about 9.0% to about 9.9% cobalt (Co), about 4.0% to about 5.25% aluminum (Al), about 0.5% to about 3.0% titanium (Ti), about 4.5% to about 5.0% tungsten (W), about 1.4% to about 1.7% molybdenum (Mo), about 3.25% to about 3.75% niobium (Nb), about 0.08% to about 0.12% carbon (C), about 0.005% to about 0.04% zirconium (Zr), about 0.010% to about 0.014% boron (B); and the balance comprising nickel (Ni) and incidental impurities.

Resulting compositions can comprise a microstructure that is substantially devoid of Eta phase. In some embodiments, the composition can comprise a microstructure that is devoid of Eta phase. In some embodiments, the composition can have a reduced amount of TCP phase. In some embodiments, the composition can be devoid of, or substantially devoid of both Eta and have a reduced amount of TCP phases.

Resulting compositions can also have relatively high gamma prime by volume fraction, such as compared to other nickel-based super alloys. For example, in some embodiments, the composition can have a volume fraction of gamma prime greater than 60%. In some embodiments, the composition can have a volume fraction of gamma prime greater than 62%. In some embodiments, the composition can have a volume fraction of gamma prime up to 64%.

Moreover, when comparing to other nickel-super based alloys, such as GTD-141 (such as the compositions disclosed in U.S. Pat. No. 6,416,596) and GTD-141+(such as the compositions disclosed in U.S. Pat. No. 9,404,388), resulting compositions of the present disclosure may produce alloys having lower liquidus temperature, lower solidus temperature, increased gamma phase by volume percent, increased strength, increased stress and/or low cycle fatigue performance, improved oxidation resistance, and/or improved weldability.

Referring now to FIG. 1, a method 10 is illustrated of forming an article having a composition disclosed herein. The method 10 may generally comprise manufacturing a composition in step 12, wherein the composition comprises, by weight percent, about 13.7% to about 14.3% chromium (Cr), about 9.0% to about 9.9% cobalt (Co), about 4.0% to about 5.25% aluminum (Al), about 0.5% to about 3.0% titanium (Ti), about 4.5% to about 5.0% tungsten (W), about 1.4% to about 1.7% molybdenum (Mo), about 3.25% to about 3.75% niobium (Nb), about 0.08% to about 0.12% carbon (C), about 0.005% to about 0.04% zirconium (Zr), about 0.010% to about 0.014% boron (B), and balance nickel (Ni) and incidental impurities.

As discussed herein, the composition may comprise one or more variations in weight percent with respect to individual elements. For example, in some embodiments, the composition comprises, by weight percent, about 4.25% to about 5.0% aluminum (Al). In some embodiments, the composition comprises, by weight percent about 1.0% to about 2.0% titanium (Ti). In some embodiments, the composition comprises, by weight percent about 4.6% to about 4.9% tungsten (W). In some embodiments, the composition comprises, by weight percent about 3.35% to about 3.65% niobium (Nb). In even some embodiments, the composition manufactured in step 12 can comprise, by weight percent, about 13.9% to about 14.1% chromium (Cr); about 9.25% to about 9.75% cobalt (Co); about 4.25% to about 5.20% aluminum (Al); about 1.0% to about 2.0% titanium (Ti); about 4.6% to about 4.9% tungsten (W); about 1.5% to about 1.6% molybdenum (Mo); about 3.35% to about 3.65% niobium (Nb); about 0.09% to about 0.11% carbon (C); about 0.01% to about 0.03% zirconium (Zr); and about 0.011% to about 0.013% boron (B).

It should be appreciated that manufacturing, as used herein, can refer to any suitable manufacturing process for nickel-based super alloys. For example, manufacturing may comprise a casting process. The casting process can include, but not be limited to, ingot casting, investment casting, or near net shape casting. In some embodiments, manufacturing may comprise directional solidification. In some embodiments, manufacturing may include additive manufacturing (e.g., three-dimensional printing using metal powder), welding, coating, machining, or the like. Moreover, manufacturing may entail any time, temperature, and pressure suitable for casting and/or heat treating nickel based super alloys.

With continued reference to FIG. 1, the method 10 may further include heat treating the composition in step 14 and any other optional or additional post processing steps in step 16. Heat treatment in step 14 can comprise any supplemental or sequential heat processing involving one or more elevated temperatures at one or more hold times. Moreover, depending in part on the particular article being manufactured, the method 10 may comprise any supplemental post processing steps such as, but not limited to, polishing, peening, cladding, coating, or the like.

Figure 2:
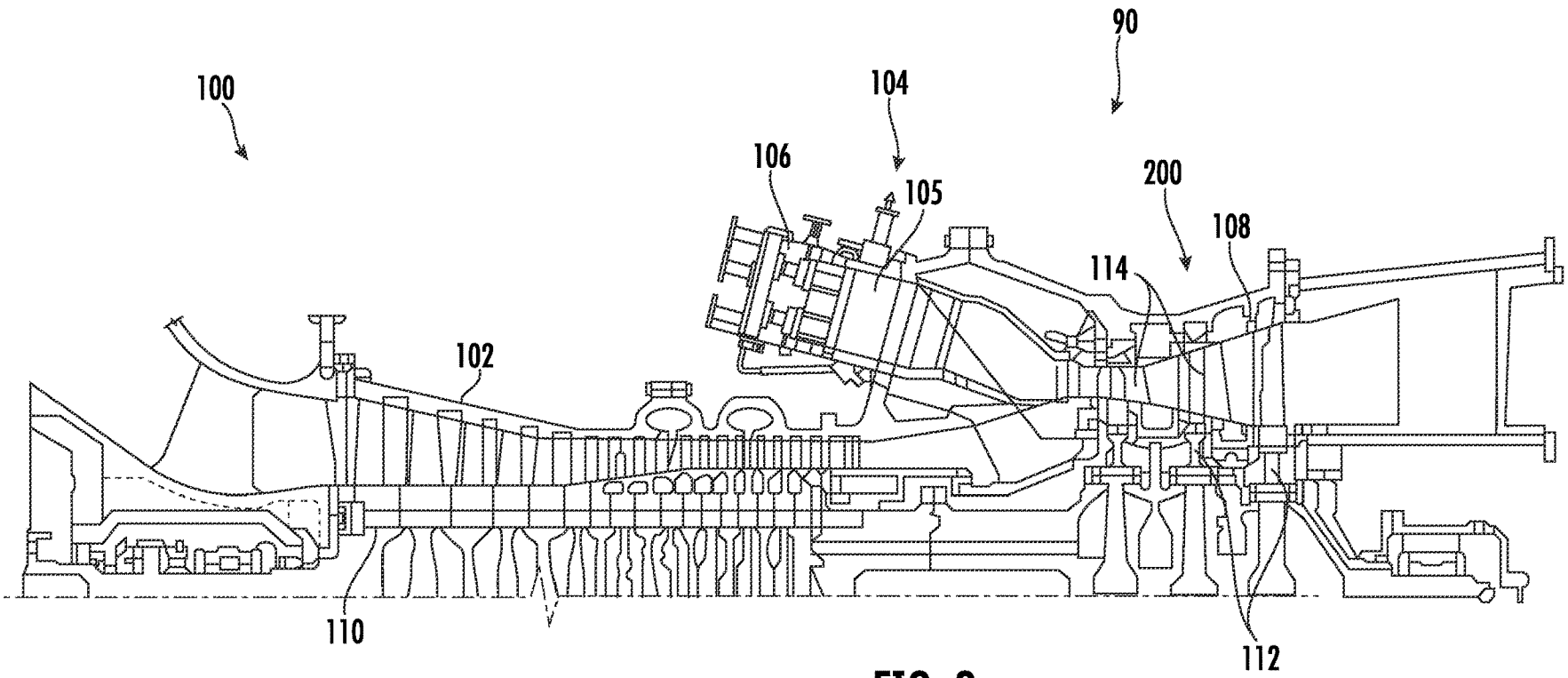
FIG. 2 is a cross-sectional view of a gas turbine engine in accordance with one or more embodiments of the present disclosure.
Figure 3:
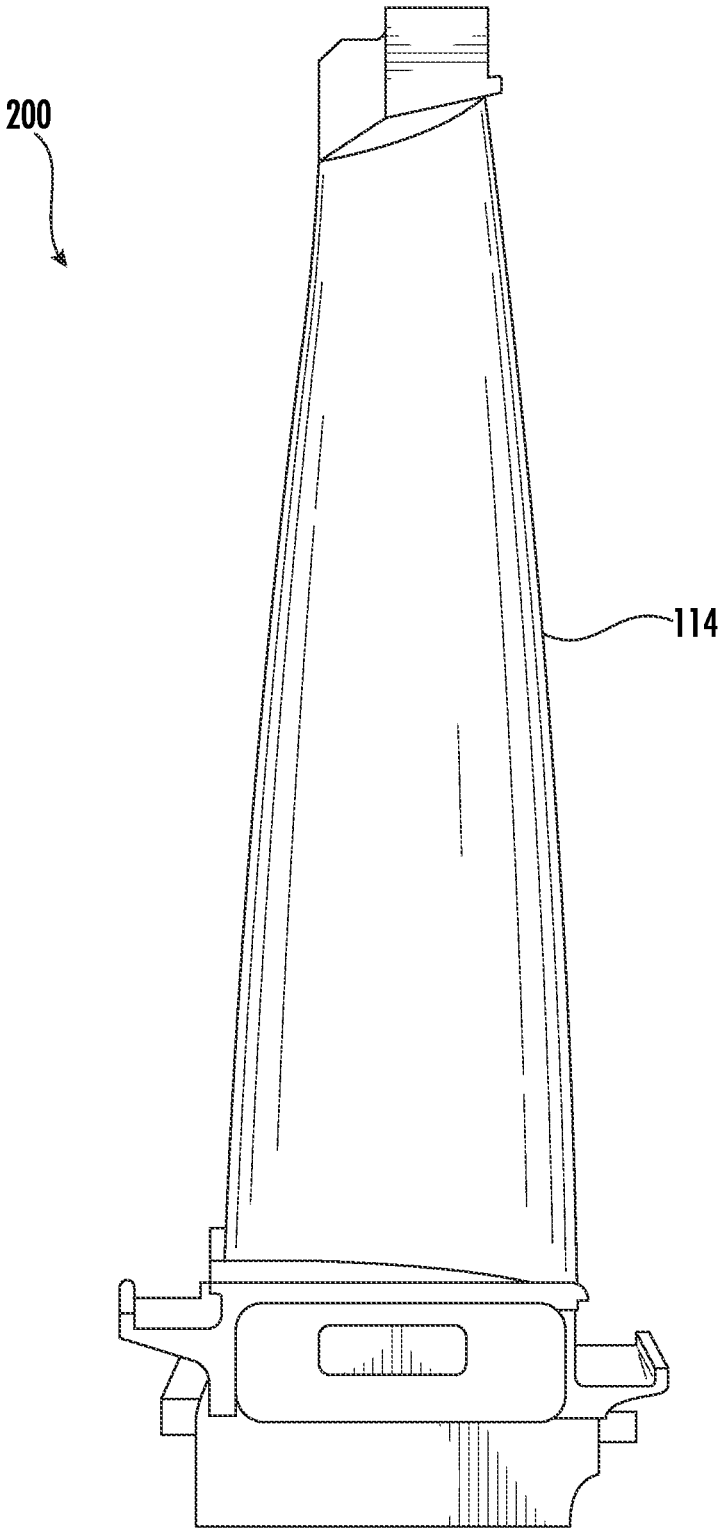
FIG. 3 an exemplary article as an article for a gas turbine engine in accordance with one or more embodiments of the present disclosure.

Referring now to FIGS. 2 and 3, an exemplary article is illustrated as a gas turbine component 200, and more specifically as a blade 114, for use in a turbomachine 90, wherein the gas turbine component 200 can comprise one or more of the compositions disclosed herein.

For example, a turbomachine 90 in the form of a combustion turbine or gas turbine system 100 is illustrated. Gas turbine system 100 includes a compressor 102 and a combustor 104. Combustor 104 includes a combustion region 105 and a fuel nozzle assembly 106. Gas turbine system 100 also includes a turbine 108 and a common compressor/turbine shaft 110 (also referred to as a rotor). A set of stationary vanes or nozzles 112 can cooperate with a set of blades 114 to form each stage of turbine 108, and to define a portion of a flow path through turbine 108.

Different hot gas path sections of the gas turbine system 100 may experience different operating conditions requiring materials forming gas turbine components 200 (e.g., hot gas path turbine components) therein to have different properties. In fact, different components in the same sections may experience different operating conditions requiring different materials.

For example, blades 114 or airfoils in the turbine section of the engine are attached to turbine wheels and rotate at very high speeds in the hot exhaust combustion gases expelled by turbine 108. These blades or airfoils may need to be oxidation-resistant and corrosion-resistant, maintaining their microstructure at elevated operating temperatures while maintaining mechanical properties, such as creep resistance/stress rupture, strength, and ductility. Because these blades have complex shapes, in order to reduce costs, they may be formed by an appropriate manner, such as casting, additively manufacturing, forging, or other suitable processes that reduce processing time as well as machining time to achieve complex shapes.

In accordance with the present disclosure, a gas turbine component 200 may comprise one or more of the compositions disclosed herein. The gas turbine component 200 may comprise any component of the gas turbine system 100, such as hot as path components. In some embodiments, the gas turbine component 200 may comprise one or more combustor components, turbine blades, shrouds, nozzles, heat shields, and vanes. For example, in some embodiments, such as that illustrated in FIG. 3, the gas turbine component 200 may comprise a blade 114. While exemplary embodiments are presented herein for different gas turbine component 200, it should be appreciated that these are exemplary only and not intended to be limiting. The compositions disclosed herein may be used for any other gas turbine component 200, such as any other article that is subject to elevated temperatures when in their operating environment.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses:

A composition comprising, by weight percent: about 13.7% to about 14.3% chromium (Cr); about 9.0% to about 9.9% cobalt (Co); about 4.0% to about 5.25% aluminum (Al); about 0.5% to about 3.0% titanium (Ti); about 4.5% to about 5.0% tungsten (W); about 1.4% to about 1.7% molybdenum (Mo); about 3.25% to about 3.75% niobium (Nb); about 0.08% to about 0.12% carbon (C); about 0.005% to about 0.04% zirconium (Zr); about 0.010% to about 0.014% boron (B); and balance nickel (Ni) and incidental impurities.

The composition of any claim herein, wherein the composition has a microstructure substantially devoid of Eta phase.

The composition of any claim herein, wherein a volume fraction of gamma prime is greater than 60%.

The composition of any claim herein, wherein the composition comprises, by weight percent, about 4.25% to about 5.0% aluminum (Al).

The composition of any claim herein, wherein the composition comprises, by weight percent, about 1.0% to about 2.0% titanium (Ti).

The composition of any claim herein, wherein the composition comprises, by weight percent about 4.6% to about 4.9% tungsten (W).

The composition of any claim herein, wherein the composition comprises, by weight percent, about 3.35% to about 3.65% niobium (Nb).

The composition of any claim herein, wherein the composition comprises, by weight percent: about 13.9% to about 14.1% chromium (Cr); about 9.25% to about 9.75% cobalt (Co); about 4.25% to about 5.20% aluminum (Al); about 1.0% to about 2.0% titanium (Ti); about 4.6% to about 4.9% tungsten (W); about 1.5% to about 1.6% molybdenum (Mo); about 3.35% to about 3.65% niobium (Nb); about 0.09% to about 0.11% carbon (C); about 0.01% to about 0.03% zirconium (Zr); and about 0.011% to about 0.013% boron (B).

The composition of any claim herein, wherein a weight percent of aluminum (Al) with respect to a weight percent of titanium (Ti) is Al=−0.5*Ti+5.5±0.05.

An article comprising a composition, the composition comprising, by weight percent: about 13.7% to about 14.3% chromium (Cr); about 9.0% to about 9.9% cobalt (Co); about 4.0% to about 5.25% aluminum (Al); about 0.5% to about 3.0% titanium (Ti); about 4.5% to about 5.0% tungsten (W); about 1.4% to about 1.7% molybdenum (Mo); about 3.25% to about 3.75% niobium (Nb); about 0.08% to about 0.12% carbon (C); about 0.005% to about 0.04% zirconium (Zr); about 0.010% to about 0.014% boron (B); and balance nickel (Ni) and incidental impurities.

The article of any claim herein, wherein the gas turbine component has a microstructure substantially devoid of Eta phase.

The article of any claim herein, wherein a weight percent of aluminum (Al) with respect to a weight percent of titanium (Ti) is Al=−0.5*Ti+5.5±0.05.

A method for forming an article, the method comprising: manufacturing a composition comprising, by weight percent: about 13.7% to about 14.3% chromium (Cr); about 9.0% to about 9.9% cobalt (Co); about 4.0% to about 5.25% aluminum (Al); about 0.5% to about 3.0% titanium (Ti); about 4.5% to about 5.0% tungsten (W); about 1.4% to about 1.7% molybdenum (Mo); about 3.25% to about 3.75% niobium (Nb); about 0.08% to about 0.12% carbon (C); about 0.005% to about 0.04% zirconium (Zr); about 0.010% to about 0.014% boron (B); and balance nickel (Ni) and incidental impurities; and heat treating the composition.

The method of any claim herein, wherein the composition has a microstructure substantially devoid of Eta phase.

The method of any claim herein, wherein a volume fraction of gamma prime is greater than 60%.

The method of any claim herein, wherein the composition comprises, by weight percent, about 4.25% to about 5.0% aluminum (Al).

The method of any claim herein, wherein the composition comprises, by weight percent, about 1.0% to about 2.0% titanium (Ti).

The method of any claim herein, wherein the composition comprises, by weight percent: about 13.9% to about 14.1% chromium (Cr); about 9.25% to about 9.75% cobalt (Co); about 4.25% to about 5.20% aluminum (Al); about 1.0% to about 2.0% titanium (Ti); about 4.6% to about 4.9% tungsten (W); about 1.5% to about 1.6% molybdenum (Mo); about 3.35% to about 3.65% niobium (Nb); about 0.09% to about 0.11% carbon (C); about 0.01% to about 0.03% zirconium (Zr); and about 0.011% to about 0.013% boron (B).

The method of any claim herein, wherein a weight percent of aluminum (Al) with respect to a weight percent of titanium (Ti) is Al=−0.5*Ti+5.5±0.05.

The method of any claim herein, wherein manufacturing the composition comprises casting.

We claim:

1. A composition comprising, by weight percent:
about 13.7% to about 14.3% chromium (Cr);
about 9.0% to about 9.9% cobalt (Co);
about 4.0% to about 5.25% aluminum (Al);
about 0.5% to about 3.0% titanium (Ti);
about 4.5% to about 5.0% tungsten (W);
about 1.4% to about 1.7% molybdenum (Mo);
about 3.25% to about 3.75% niobium (Nb);
about 0.08% to about 0.12% carbon (C);
about 0.005% to about 0.04% zirconium (Zr);
about 0.010% to about 0.014% boron (B); and
balance nickel (Ni) and incidental impurities.

2. The composition of claim 1, wherein the composition has a microstructure substantially devoid of Eta phase.

3. The composition of claim 1, wherein a volume fraction of gamma prime is greater than 60%.

4. The composition of claim 1, wherein the composition comprises, by weight percent, about 4.25% to about 5.0% aluminum (Al).

5. The composition of claim 1, wherein the composition comprises, by weight percent, about 1.0% to about 2.0% titanium (Ti).

6. The composition of claim 1, wherein the composition comprises, by weight percent about 4.6% to about 4.9% tungsten (W).

7. The composition of claim 1, wherein the composition comprises, by weight percent, about 3.35% to about 3.65% niobium (Nb).

8. The composition of claim 1, wherein the composition comprises, by weight percent:
about 13.9% to about 14.1% chromium (Cr);
about 9.25% to about 9.75% cobalt (Co);
about 4.25% to about 5.20% aluminum (Al);
about 1.0% to about 2.0% titanium (Ti);
about 4.6% to about 4.9% tungsten (W);
about 1.5% to about 1.6% molybdenum (Mo);
about 3.35% to about 3.65% niobium (Nb);
about 0.09% to about 0.11% carbon (C);
about 0.01% to about 0.03% zirconium (Zr); and
about 0.011% to about 0.013% boron (B).

9. The composition of claim 1, wherein a weight percent of aluminum (Al) with respect to a weight percent of titanium (Ti) is Al=−0.5*Ti+5.5±0.05.

10. A gas turbine component comprising, by weight percent:
about 13.7% to about 14.3% chromium (Cr);
about 9.0% to about 9.9% cobalt (Co);
about 4.0% to about 5.25% aluminum (Al);
about 0.5% to about 3.0% titanium (Ti);
about 4.5% to about 5.0% tungsten (W);
about 1.4% to about 1.7% molybdenum (Mo);

about 3.25% to about 3.75% niobium (Nb);
about 0.08% to about 0.12% carbon (C);
about 0.005% to about 0.04% zirconium (Zr);
about 0.010% to about 0.014% boron (B); and
balance nickel (Ni) and incidental impurities,
wherein, the gas turbine component comprises a hot gas path turbine component.

11. The gas turbine component of claim 10, wherein the gas turbine component has a microstructure substantially devoid of Eta phase.

12. The gas turbine component of claim 10, wherein a weight percent of aluminum (Al) with respect to a weight percent of titanium (Ti) is Al=−0.5*Ti+5.5±0.05.

13. A method for forming an article, the method comprising:
manufacturing a composition comprising, by weight percent:
about 13.7% to about 14.3% chromium (Cr);
about 9.0% to about 9.9% cobalt (Co);
about 4.0% to about 5.25% aluminum (Al);
about 0.5% to about 3.0% titanium (Ti);
about 4.5% to about 5.0% tungsten (W);
about 1.4% to about 1.7% molybdenum (Mo);
about 3.25% to about 3.75% niobium (Nb);
about 0.08% to about 0.12% carbon (C);
about 0.005% to about 0.04% zirconium (Zr);
about 0.010% to about 0.014% boron (B); and
balance nickel (Ni) and incidental impurities; and
heat treating the composition.

14. The method of claim 13, wherein the composition has a microstructure substantially devoid of Eta phase.

15. The method of claim 13, wherein a volume fraction of gamma prime is greater than 60%.

16. The method of claim 13, wherein the composition comprises, by weight percent, about 4.25% to about 5.0% aluminum (Al).

17. The method of claim 13, wherein the composition comprises, by weight percent, about 1.0% to about 2.0% titanium (Ti).

18. The method of claim 13, wherein the composition comprises, by weight percent:
about 13.9% to about 14.1% chromium (Cr);
about 9.25% to about 9.75% cobalt (Co);
about 4.25% to about 5.20% aluminum (Al);
about 1.0% to about 2.0% titanium (Ti);
about 4.6% to about 4.9% tungsten (W);
about 1.5% to about 1.6% molybdenum (Mo);
about 3.35% to about 3.65% niobium (Nb);
about 0.09% to about 0.11% carbon (C);
about 0.01% to about 0.03% zirconium (Zr); and
about 0.011% to about 0.013% boron (B).

19. The method of claim 13, wherein a weight percent of aluminum (Al) with respect to a weight percent of titanium (Ti) is Al=−0.5*Ti+5.5±0.05.

20. The method of claim 13, wherein manufacturing the composition comprises casting.

* * * * *